United States Patent [19]

Miknaitis

[11] 4,023,262

[45] May 17, 1977

[54] METHOD OF WINDING DIFFERENTIAL COILS ON A MAGNETIC LATCHING REED SWITCH CROSS POINT BOBBIN

[75] Inventor: Sigitas Miknaitis, Clarendon Hills, Ill.

[73] Assignee: GTE Automatic Electric Laboratories Incorporated, Northlake, Ill.

[22] Filed: July 8, 1976

[21] Appl. No.: 703,486

[52] U.S. Cl. ..... 29/605; 29/418

[51] Int. Cl.[2] ..... H01F 41/06

[58] Field of Search ..... 29/605, 618, 622, 418; 242/7.03; 335/151–154; 336/198, 208

[56] References Cited

UNITED STATES PATENTS

| | | | |
|---|---|---|---|
| 3,286,327 | 11/1966 | Ganci | 29/618 |
| 3,783,421 | 1/1974 | Miknaitis | 335/152 |

*Primary Examiner*—Carl E. Hall

*Attorney, Agent, or Firm*—Donald J. Lenkszus; David W. Heid

[57] ABSTRACT

A magnetic latching reed switch bobbin is wound on an automatic coil winding machine with a single polyurethane insulated wire by employing a bobbin having a base at one end with an extra terminal post mounted thereon in addition to the four terminals required for the primary and secondary coils and their associated contact pins, initially securing the end of the coil wire to a primary coil terminal, winding a bottom primary coil in a counterclockwise direction in a bottom coil compartment adjacent the base, connecting the wire to the extra terminal, feeding the wire to an adjacent secondary coil terminal so as to form a strap between the two terminals, winding in a counterclockwise direction a bottom secondary coil over the bottom primary coil, feeding the wire across a flange separating bottom and top coil compartments and housing a shunt plate assembly, winding a primary coil in a clockwise direction in the top coil compartment, returning the wire across the shunt plate assembly and across the previously wound bottom coils to a primary terminal on the side of the base flange opposite the first mentioned primary terminal and then to an adjacent secondary terminal to form a connecting strap, feeding the wire upwardly across the bottom coils and the shunt plate assembly, winding a top secondary coil in the counterclockwise direction on the top primary coil, feeding the wire back across the shunt plate assembly and the bottom coils and terminating the wire upon connecting it to the extra terminal and removing the wire straps connecting the two sets of terminals.

6 Claims, 6 Drawing Figures

METHOD OF WINDING DIFFERENTIAL COILS ON A MAGNETIC LATCHING REED SWITCH CROSS POINT BOBBIN

This invention relates to the fabrication of electromagnetic switches, of the magnetic latching reed switch type, and is more particularly concerned with improvements in the method of winding on a reed switch cross point bobbin the necessary capsule energizing coils.

There are obvious advantages in being able to provide magnetic latching reed switches which can be readily mounted in a socket on a printed wiring card without the need for soldering any connections when mounting the switch. This type switch has found wide acceptance as a cross point in switching matrices. One recently developed form of this type switch is disclosed in U.S. Pat. No. 3,783,421, granted Jan. 1, 1974, to Sigitas Miknaitis wherein the reed capsules are housed in axially extending internal compartments in a bobbin which has a base forming flange at one end with a plurality of coil terminals and associated pins for entering into contact apertures arranged in a corresponding pattern in a wiring card. A shunt plate mounting flange, axially spaced from the base, divides the bobbin into two coil compartments in which the energizing coils are disposed. In winding the coils it has been found desirable, for reasons of economy, to employ a continuous length of wire with conventional insulation coating and fully automated coil winding machines. It is also desirable to prevent electromagnetic imbalance by winding the secondary coil of each set thereof on the outside of the associated primary coil and to avoid any need for any special insulation between the primary and secondary coils and on the lead wires to the coil terminals. It is a general object, therefore, to provide a magnetic latching reed switch arrangement and a method of winding the energizing coils on the capsule enclosing bobbin with coil wire having conventional insulation coating so as to properly position the coils relative to each other and to avoid any need for any special insulation of the coils or the leads to the terminals for connecting them to mounting pins supported in a common base structure on the bobbin.

It is a more specific object of the invention to provide an economical system for fabricating a magnetic latching reed switch which comprises winding the energizing coil assemblies on a hollow bobbin in which the reed capsules are housed with primary and secondary coil assemblies disposed in axially spaced, coil receiving compartments by employing automatic coil winding machinery and a continuous length of insulated coil wire and winding the coils in a sequence and in a predetermined direction which places the secondary coil windings in proper position on the outside of the primary coil windings with the leads from the coils running to properly spaced terminals on a common base at one end of the bobbin and with all of the leads from the coils disposed on the exposed outer faces of the coils.

It is another object of the invention to provide a method of winding capsule energizing coils on a hollow reed switch bobbin which has axially spaced coil areas and a base forming bottom flange in which are mounted coil terminals and associated contact pins together with an extra terminal post, wherein the coils are wound and connected to the terminals on automatic coil winding machines employing a continuous length of insulated coil wire, the bottom primary coil is wound in a predetermined direction in a bottom coil area which is separated from the top coil area by a shunt plate mounting with the coil wire initially connected to a first coil terminal and at the end of the winding to a second coil terminal through the extra terminal post from which it is fed back to the bottom coil area and the bottom secondary coil is wound in the same direction onto the bottom primary coil, after which the top primary and secondary coils are wound successively, in the opposite direction and in the same direction, respectively, with the wire being fed between the winding of the two top coils across the shunt plate and the bottom coils to a connection with a third coil terminal and an adjacent fourth coil terminal and then back to the top coil area and with the wire at the end of the winding operations fed back down to the extra terminal post which serves to connect the leads from the bottom primary and top secondary coils upon subsequent removal of the wire connecting the extra terminal post and the second coil terminal.

Still another object of the invention is to provide a system for winding capsule energizing coils on a bobbin for a magnetic latching reed switch which enables the winding of the coils on automatic winding machines employing a continuous length of insulated coil wire and feeding the wire so as to wind, successively, primary and secondary coils in axially spaced relation with leads running to terminals at one end of the bobbin and outside of the coil windings so as to eliminate any need for the use of special insulation on the leads to prevent possible shorting while avoiding any sandwiching of the leads between coil windings which could cause electromagnetic imbalance.

To this end, the invention, as claimed herein, is embodied in a system or method for winding reed capsule energizing coils on a magneic latching reed switch bobbin having peripherally spaced coil terminals on a base forming flange at one end of the bobbin and axially spaced coil receiving areas or compartments separated by a shunt plate mounting wherein the coils are wound on automatic coil winding apparatus employing a length of continuous insulated coil wire which method comprises attaching the end of the coil wire to a first coil terminal on the bobbin base, winding in a counterclockwise direction a primary coil of the required turns in the bottom coil receiving compartment adjacent the base and connecting the wire to a terminal on the base which subsequently serves as a connector between the primary coil in the bottom coil receiving compartment and the secondary coil in the top coil receiving compartment and also connecting the wire to a second coil terminal, feeding the wire back to the bottom coil receiving compartment, winding in a counterclockwise direction a bottom secondary coil of the required number of turns over the bottom primary coil, feeding the wire across the shunt plate to the top coil receiving compartment and winding in a clockwise direction therein a top primary coil, feeding the wire back across the shunt plate and the bottom coils and connecting it first to a third coil terminal and then to a fourth coil terminal, feeding the wire back across the bottom coils and the shunt plate, winding in a counterclockwise direction a top secondary coil on the top primary coil, feeding the wire back across the shunt plate and the bottom coils and connecting the end thereof to the connector forming terminal, and finally removing the connecting wire between the third and fourth mentioned terminals and between the second mentioned terminal and the connector forming terminal.

The aforesaid objects and other objects and advantages of the invention will become more apparent when reference is made to the detailed description of the preferred embodiment of the invention which is set forth hereinafter by way of example, and shown in the accompanying drawings, wherein.

Referring first to FIGS. 1 to 4, there is illustrated an improved magnetic latching reed switch assembly which comprises a bobbin 10 adapted to hold two magnetic latching reed switch capsules (not shown) and the energizing coil assemblies 12 and 14 required for operation of the same. The hollow bobbin 10 has a base 16 for mounting therein the capsule and coil terminals enabling the switch assembly to be mounted or supported on a printed wiring card (not shown) which is provided with apertures in a pattern corresponding to the pattern of the coil terminals and the capsule or switch terminals which project from the bottom face of the base 16 when the assembly is in the position shown in FIGS. 1 to 3.

Figure 1:
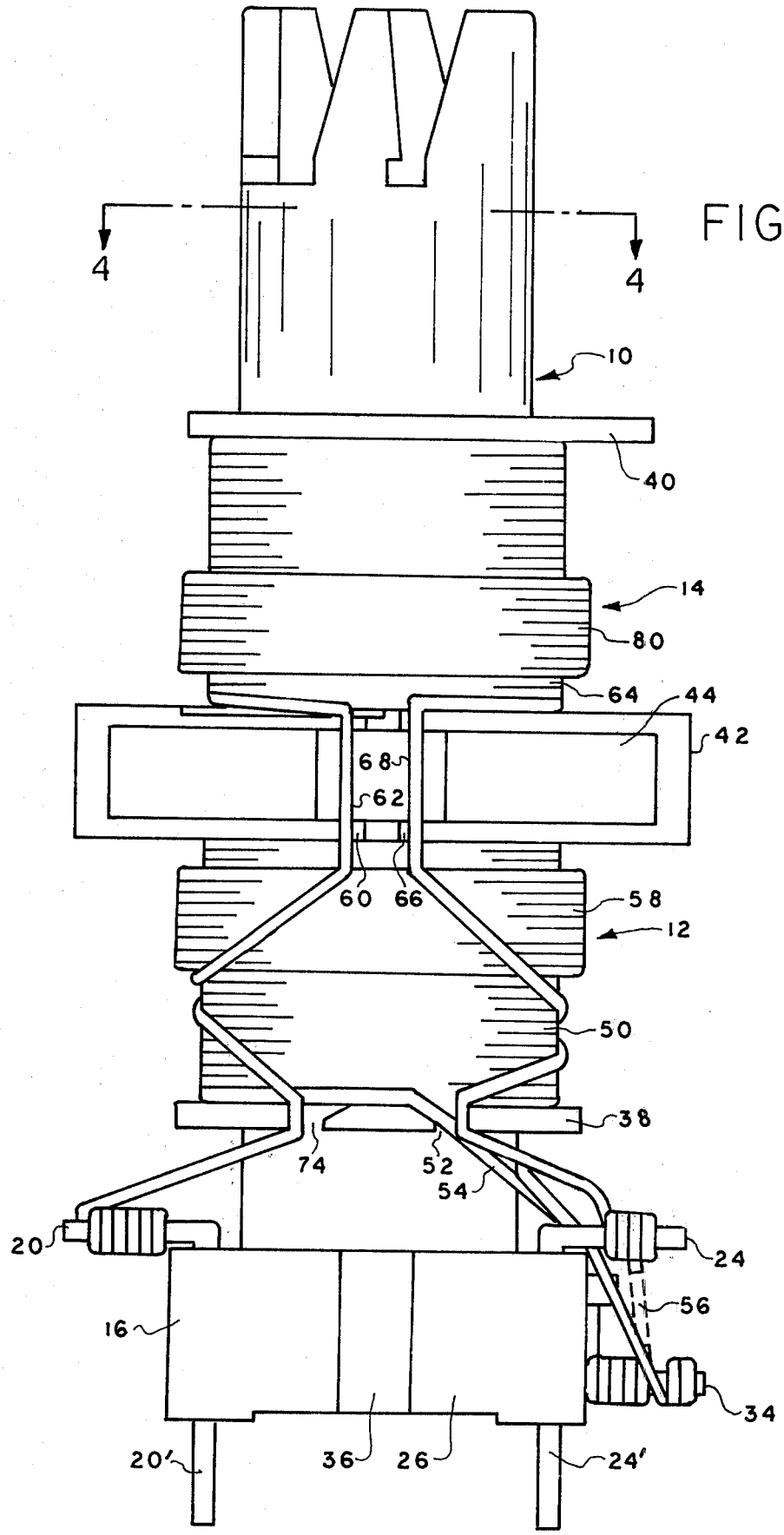
FIG. 1 is a side elevational view of a bobbin for two magnetic latching reed switch capsules with differential energizing coils wound thereon in accordance with the winding method of the present invention, the assembly being shown in an upright position in which it will be disposed when mounted on a horizontally disposed wiring card surface.
Figure 2:
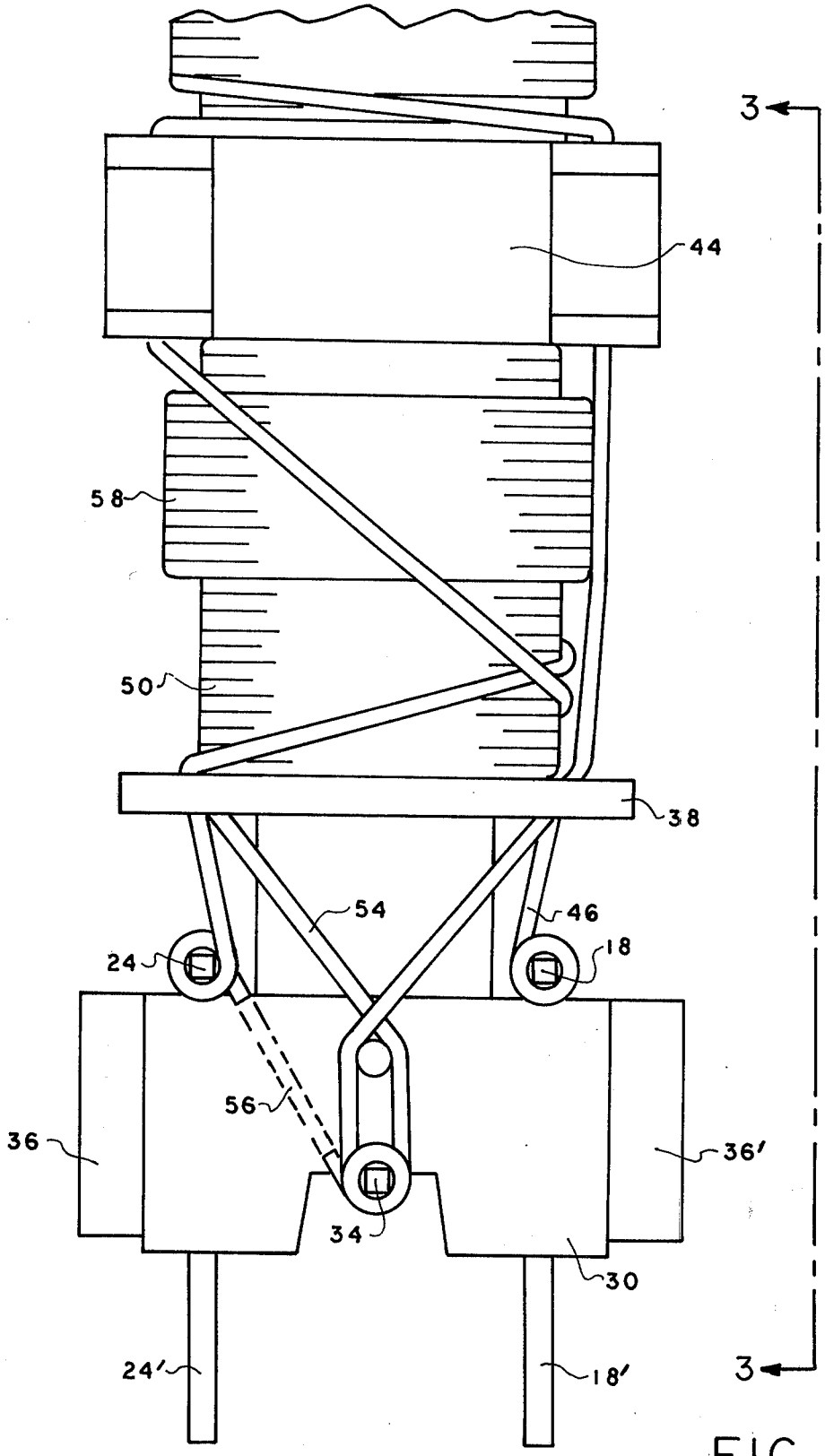
FIG. 2 is a partial side elevational view of the wound bobbin of FIG. 1, showing the adjoining side or end face thereof.

The bobbin 10 is typically molded from a suitable insulative thermoplastic material. The base 16 is provided with four inverted L-shaped terminals for the coils which are designated 18, 20, 22 and 24 (FIG. 4) and each of which has the longer leg projecting through the base 16 and extending from the lower face thereof so as to form contact pin members 18', 20', 22' and 24' while the shorter leg extends horizontally at the top of the base, as viewed in FIGS. 1 to 3, for soldering thereto the leads from the energizing coils. The base is generally rectangular (FIG. 4) with oppositely disposed near and far side faces 26, 28, when viewed as shown in FIG. 1, and oppositely disposed end faces 30, 32, with end face 30 being shown in FIG. 2. The terminals 18 and 20 are disposed so as to extend from opposite end faces 30 and 32 of the base and diagonally opposite each other while terminal 24 is disposed to extend from the same end face 30 of the base as terminal 18 with terminal 22 extending from the side face 32 of the base. A fifth terminal 34 is located on the end face 30 between the terminals 18 and 24 in a triangular arrangement which does not include a contact leg but merely extends horizontally from the end face 30 between and below the terminals 18 and 24 and serves a purpose hereinafter set forth. The base 16, in the form illustrated, is provided with extensions 36 and 36' on the oppositely disposed side faces 26 and 28 between the terminal bearing sides which extensions have vertical apertures for accommodating capsule return straps (not shown) extending downwardly from the top of the bobbin. The return straps and lower capsule terminal members are not shown on the drawings since their exact location is not essential to an understanding of the invention so long as they are disposed in non-contacting or non-conducting relation with the coils and are installed without interference with the coil winding procedure. The bobbin 10 is provided with integrally formed, circumferential spacers 38, 40 which are axially spaced above the base forming flange 16 and a molded, circumferential flange 42 adapted to receive and retain a magnetic shunt element or shunt plate 44. A bobbin of the type which is described herewith is disclosed in U.S. Pat. No. 3,783,421, to which resort may be had for structural details thereof which are not herein illustrated or described.

Figure 4:
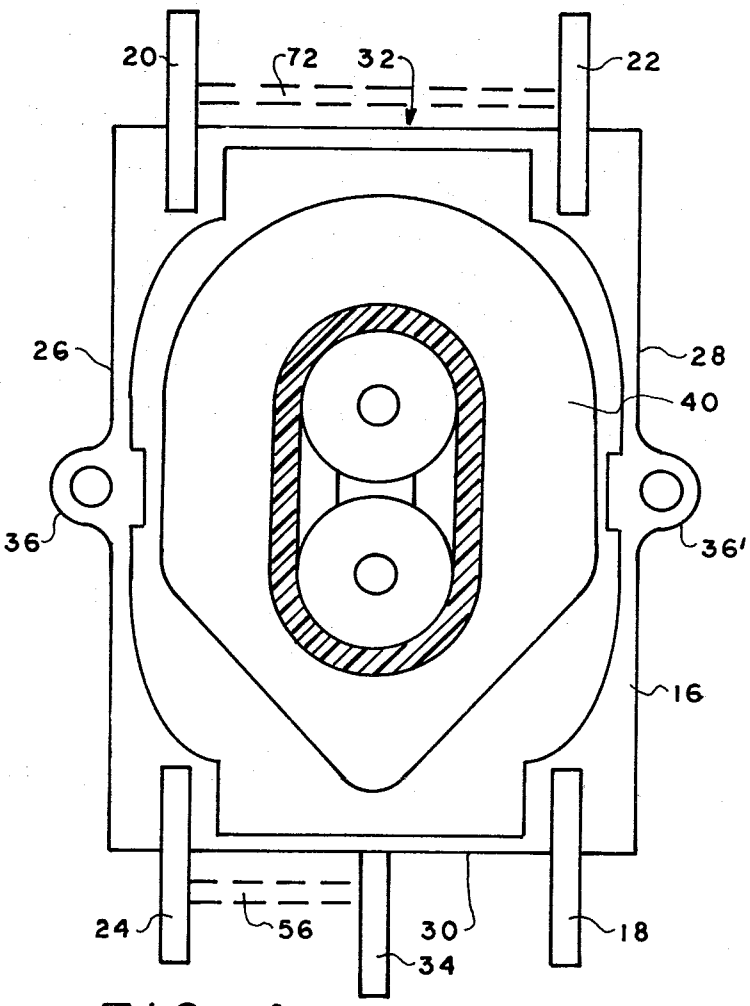
FIG. 4 is a cross sectional view taken on the line 4—4 of FIG. 1.
Figure 3:
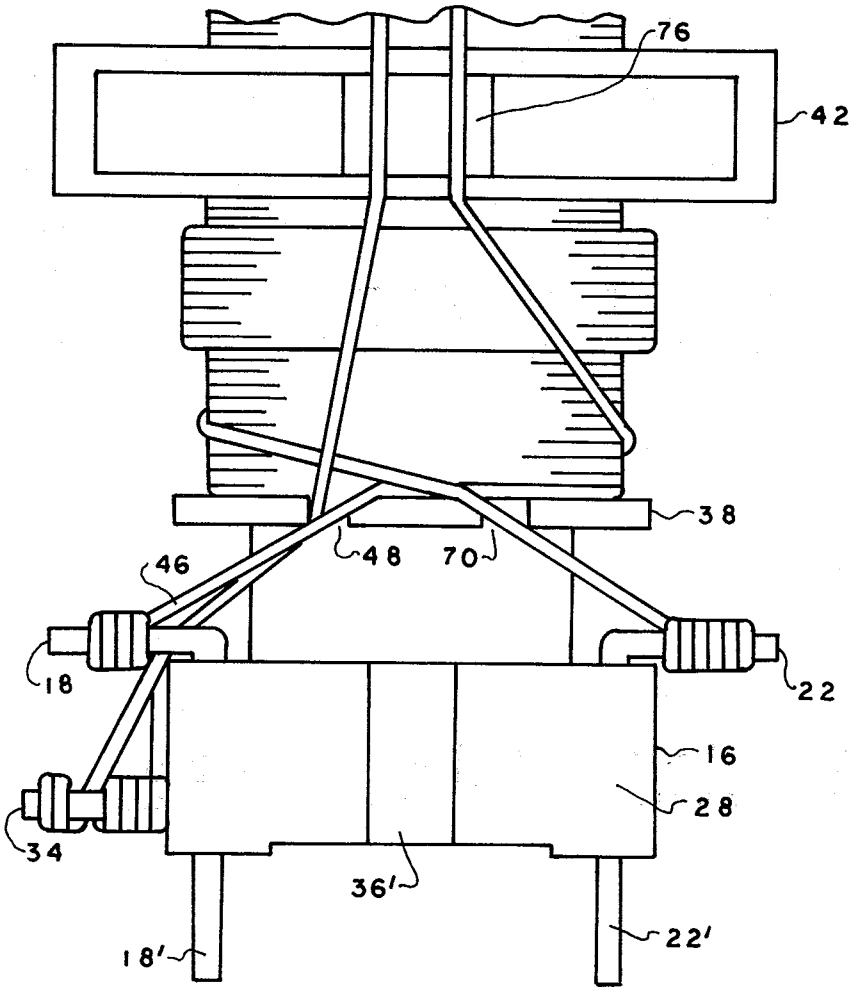
FIG. 3 is a partial side elevational view of the wound bobbin of FIG. 1 showing a portion of the side or face thereof which is opposite the side shown in FIG. 1, the view being indicated on the line 3—3 of FIG. 2.
Figure 6:
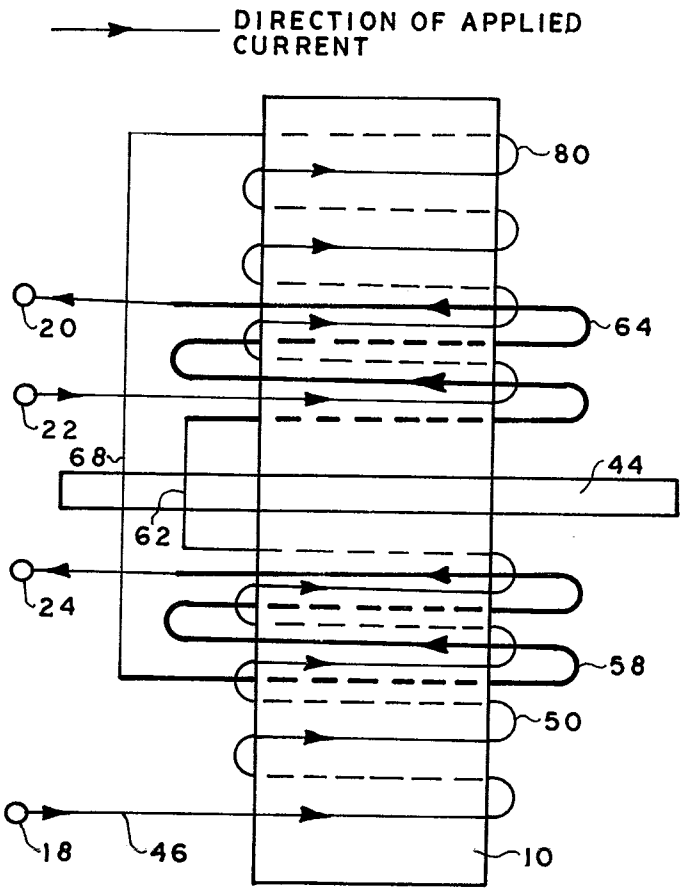
FIG. 6 is a schematic view illustrating the finished winding.
Figure 5:
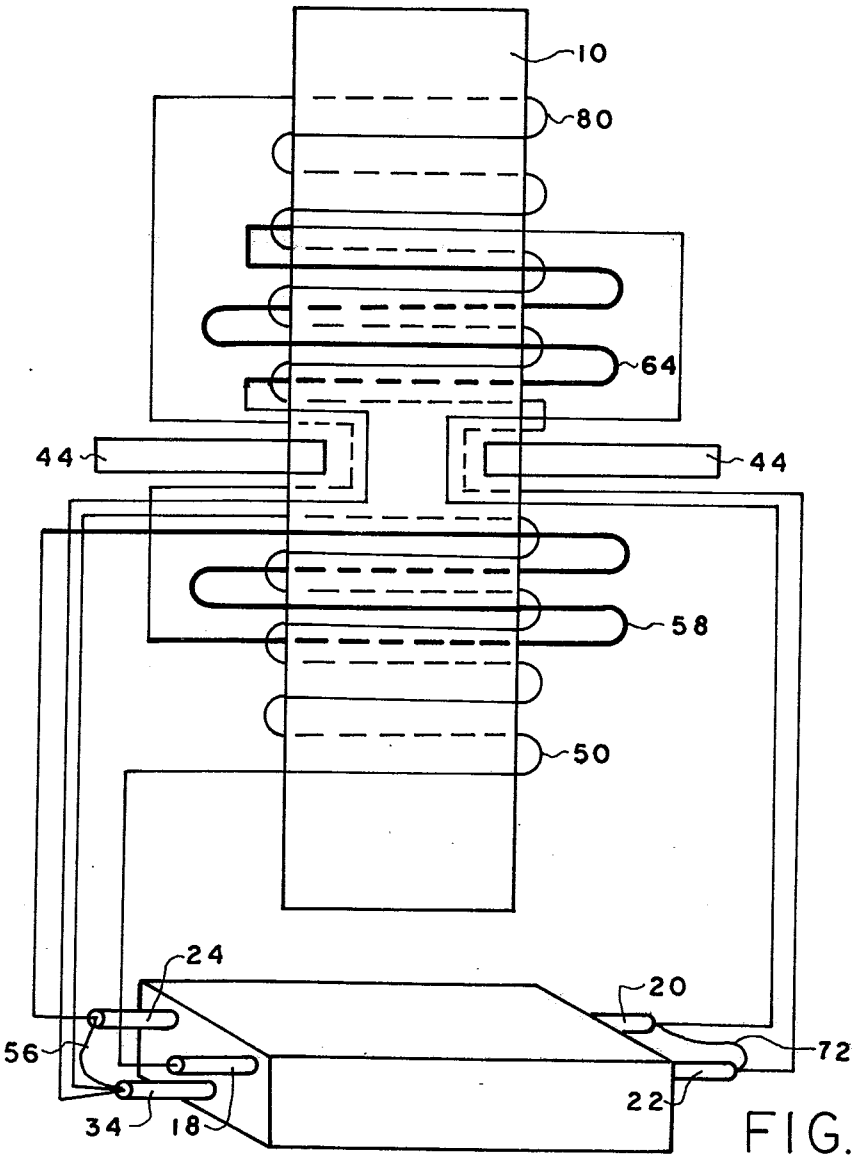
FIG. 5 is a schematic view illustrating the winding procedure.

The bobbin 10 is adapted to be provided with differential wound coil assemblies 12 and 14 required for reed switch operation by the procedure hereinafter described. Prior to insertion of the reed capsules into the hollow bobbin body the energizing coils are wound on the bobbin with coil wire, which is, typically, a single length of polyurethane insulated 29 gauge copper wire, and the winding is accomplished by employing automatic coil winding machinery of conventional construction following the hereinafter described sequence of operations. The end 46 of the coil wire is first attached to the terminal 18 (FIGS. 2 and 3) which extends from the end face 30 of the bobbin base 16. It is then fed through the slot 48 (FIG. 3) on the side of the bottommost spacer 38 which is located above the side face 28 of the bobbin base 16, and wound in a counterclockwise direction on the bobbin in the coil receiving compartment formed between the spacer 38 and the flange 42 with the proper number of turns for the bottom primary coil 50. In the form shown this results in two layers of the coil wire. The wire is then fed down through the slot 52 in spacer 38, which is on the side of the assembly shown in FIG. 1, and attached to terminal 34 on the face 30 of the base 16 to complete the bottom primary winding 50. The wire portion indicated at 54 (FIG. 2) is wound about the terminal 34 so as to attach it to the terminal. From the terminal 34 the wire is fed to and wound without breaking about the terminal 24 (FIGS. 1 and 4) so as to form a connecting strap 56, which is shown in phantom line in FIG. 2. From terminal 24 the wire is fed through slot 52 (FIG. 1) and the lower secondary coil 58 is wound in a counterclockwise direction and in overlying relation on the primary coil 50, the required number of turns being wound in a double layer on the exposed face of coil 50. The wire is then fed to the top coil receiving compartment of the bobbin through the slot 60 (FIG. 1) in the shunt plate flange 42. This section of the wire is indicated at 62 in FIG. 1. The top primary coil 64 is wound in a clockwise direction on the bobbin 10 in the area or compartment formed between the shunt plate flange 42 and the top spacer 40, with the required number of turns wound thereon in a double layer arrangement. The wire is then brought down through the slot 66 in the shunt plate flange 42 (FIG. 1), the wire portion or section at this point being indicated at 68. The wire is continued downwardly and around the outside or outer faces of the bottom coils 50, 58 and through the slot 70 (FIG. 3) in the bottom spacer 38 for connection to the coil terminal 22 which extends from the face 32 of the base flange 16 in spaced relation to terminal 20. The wire is wound about the terminal 22 and continued to the terminal 20 which also extends from the face 32 of the base flange 38 and about which the wire is wound to thereby connect the terminals 22 and 20 by a strap forming portion 72 of the wire (FIG. 4). From the terminal 20 the wire is fed through the slot 74 (FIG. 1) in the bottom spacer 38 and upward and around the outside of the coils 50, 58, and through the slot 76 (FIG. 3) in the shunt plate flange 42 to the top coil area or compartment where it is wound in a counterclockwise direction around and on the top of the top primary coil 64 with the required number of turns which forms a double layer secondary coil 80. When the top coil 80 is completed the wire is fed back down through the slot 76 (FIG. 3) in the shunt plate flange 42, across the bottom coil assemblies 50 and 58 and through the slot 48 for connection to the terminal 34. Upon completion of the coil wiring operations, the terminal connections may be soldered and the connecting straps 56 and 72 (FIGS. 2 and 4) between the terminals 34, 24 and 20, 22 removed so as to leave the coils in the proper wiring relation, as shown in FIG. 6, for switch operation.

I claim:

1. A method of winding primary and secondary energizing coils on a magnetic latching reed switch bobbin having an axial chamber for mounting therein a pair of reed switch capsules wherein the coils are wound with a single continuous strand of coil wire and the winding is effected on automatic coil winding equipment, the bobbin having a base flange at one end adapted for supporting primary and secondary coil terminals and associated contact pins for insertion in a receptacle of a wiring circuit which method comprises attaching the end of the coil wire to a primary coil terminal, winding a primary coil in a predetermined direction in a coil area adjacent the base flange, attaching the wire to a connector post and running the wire from the post to a secondary coil terminal, winding a secondary coil on the primary coil in the same direction, feeding the wire to a coil receiving area remote from the base across an intervening shunt plate, winding a primary coil in that area in the opposite direction and feeding the wire back across the shunt plate and the previously wound coils and connecting it to a primary coil terminal and then to an adjacent secondary coil terminal, feeding the wire across the previously wound coils on the adjacent coil receiving area and across the shunt plate, winding the secondary coil on the primary coil in the remote coil receiving area in the direction as the first coil winding, returning the wire across the shunt plate and the first set of primary and secondary windings to the connecting post, and finally removing the wire section connecting the post with the secondary coil terminal and the wire section connecting the last mentioned primary and secondary coil terminals.

2. A method of winding coils on a reed switch bobbin as set forth in claim 1 which includes winding each of the primary and secondary coils in the adjacent and remote coil receiving areas in an even number of layers with the winding of each coil beginning and ending on the side of the coil area which is nearest to the terminal supporting base and thereby avoiding any sandwiching of the coil leads between the coil windings.

3. A method of winding coils on a reed switch bobbin as set forth in claim 1 which includes feeding the lead forming sections of the coil wire in paths which extend across the exposed face of the outermost coil in the coil receiving area adjacent the base formation on the bobbin.

4. A method of winding coils on a reed switch bobbin as set forth in claim 1 which includes winding the primary and secondary coils in the area adjacent the base formation in a counterclockwise direction on the bobbin, winding the primary coil in the coil receiving area remote from the base formation in a clockwise direction on the bobbin and winding the secondary coil in that area in the counterclockwise direction on the bobbin.

5. A method of winding coils on a reed switch bobbin as set forth in claim 1 which includes winding the associated primary and secondary coils in at least two layers with the winding beginning and terminating on the side of the coil receiving area which is nearest the bobbin base formation so as to enable the lead wires to the terminals to be fed across the outermost faces of the coils which are wound in the area adjacent the bobbin base formation.

6. A method of winding differential coils on a hollow bobbin for a magnetic latching reed switch which has terminal forming members on a supporting flange which constitutes a base at one end and axially separated, peripherally slotted coil spacers with a peripherally slotted shunt plate mounting flange dividing the area between the coil spacers so as to define two axially spaced compartments for receiving primary and secondary coils, which method comprises attaching the end of a continuous length of wire to a first coil terminal, threading the wire through a slot in the lowermost coil spacer and winding the wire in a counterclockwise direction on the bobbin in the bottom coil receiving compartment in layers so as to form a bottom coil with the winding beginning and ending adjacent the lowermost spacer, threading the wire through a second slot in the lowermost spacer and attaching the wire to a connector post mounted adjacent the first coil terminal, continuing the wire to a connection with a second coil terminal so as to form a strap between the connector post and said second coil terminal, threading the wire through said second slot in the lowermost coil spacer and winding a secondary coil on the primary coil in a counterclockwise direction, threading the wire through a slot in the shunt plate flange and winding a primary coil in a clockwise direction in the top coil receiving compartment so as to complete the winding adjacent the shunt plate flange, threading the wire through a second slot in the shunt plate flange and down across the outside faces of the coils in the bottom compartment and through a third slot in the lowermost spacer and connecting the wire to a third coil terminal, continuing the wire to a fourth coil terminal so as to form a strap between said third and fourth coil terminals, threading the wire through a fourth slot in the lowermost spacer and upwardly along the outside faces of the bottom coils, and through a third slot in the shunt plate flange, winding the wire in overlying relation about the top primary coil in a counterclockwise direction so as to form a double layer top secondary coil, threading the wire downwardly through a fourth slot in the shunt plate flange and across the outside faces of the bottom coils and through said second slot in said lowermost spacer and connecting the wire to said connector post and removing said strap portions between said third and fourth coil terminals and between said connecting post and said second coil terminal.

* * * * *